US005542998A

United States Patent [19]

Bucerius et al.

[11] Patent Number: 5,542,998

[45] Date of Patent: Aug. 6, 1996

[54] GAS-GENERATING MIXTURE

[75] Inventors: Klaus M. Bucerius; Helmut Schmid, both of Karlsruhe, Germany

[73] Assignee: Fraunhofer Gesellschaft zur Forderung der Angewandten Forschung e.V., Munich, Germany

[21] Appl. No.: 373,019

[22] Filed: Jan. 17, 1995

[30] Foreign Application Priority Data

Jan. 18, 1994 [DE] Germany ..... 44 01 213.6

[51] Int. Cl.[6] ..... C06B 31/00

[52] U.S. Cl. ..... 149/45; 149/88; 149/105

[58] Field of Search ..... 149/45, 88, 105

[56] References Cited

U.S. PATENT DOCUMENTS

| | | | |
|---|---|---|---|
| 2,604,391 | 7/1952 | Taylor et al. | 149/38 |
| 3,664,898 | 5/1972 | Taylor et al. | 149/41 |
| 4,336,085 | 6/1982 | Walker et al. | 149/45 |
| 4,632,714 | 12/1986 | Abegg et al. | 149/2 |
| 4,931,112 | 7/1990 | Wardle et al. | 149/88 |
| 4,994,123 | 2/1991 | Patrick et al. | 149/2 |
| 5,145,535 | 9/1992 | Patrick | 149/109.6 |
| 5,198,046 | 3/1993 | Bucerius et al. | 149/61 |

FOREIGN PATENT DOCUMENTS 6588643 10/1951 United Kingdom .

*Primary Examiner*—Charles T. Jordan
*Assistant Examiner*—John R. Hardee
*Attorney, Agent, or Firm*—Antonelli, Terry, Stout & Kraus

[57] ABSTRACT

Gas-generating mixtures for rescue and air bag systems, as well as rocket and tubular weapon drive systems comprise high nitrogen and low carbon fuels GZT, TAGN, NG or NTO catalysts for pollutant gas reduction/reaction acceleration of $V_2O_5/McO_3$ mixed oxides and/or oxide mixtures, the oxidizer $Cu(NO_3)_2*3Cu(OH)_2$, which permits a cold, rapid combustion and optionally the additional coolant $Fe_2O_3$, which has further oxidizer characteristics.

20 Claims, 1 Drawing Sheet

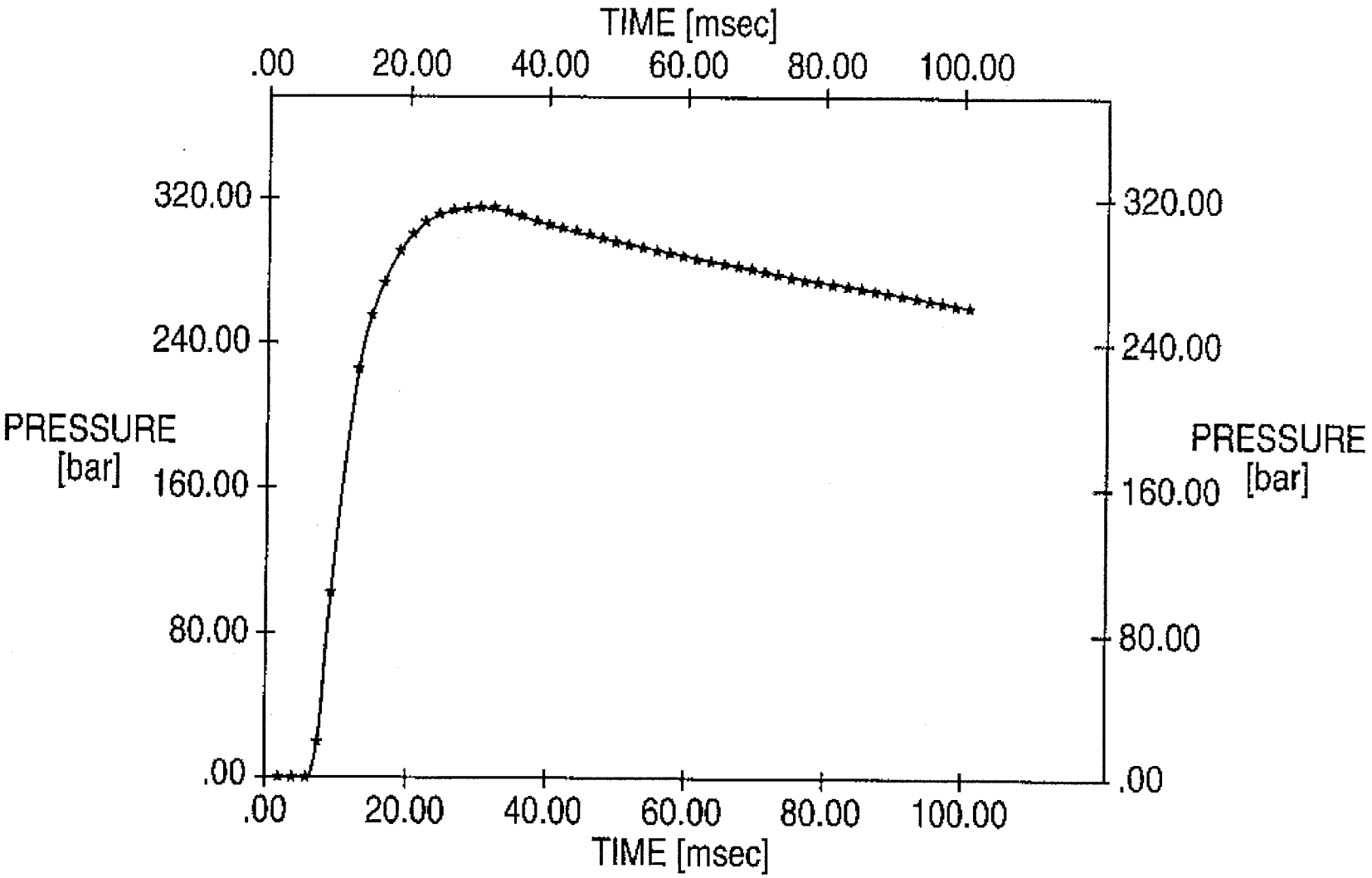
PRESSURE [bar]
320.00
240.00
160.00
80.00
.00
TIME [msec]
.00
20.00
40.00
60.00
80.00
100.00
PRESSURE [bar]
320.00
240.00
160.00
80.00
.00
TIME [msec]
.00
20.00
40.00
60.00
80.00
100.00

GAS-GENERATING MIXTURE

FIELD OF THE INVENTION

The invention relates to a gas-generating mixture of a fuel, an oxidizer, a catalyst and a coolant.

BACKGROUND OF THE INVENTION

Gas-generating mixtures of the aforementioned type, also known as gas generator sets, are characterized in that they permit a high gas output (>14 mole/kg) on combustion. They are used for rocket and tubular weapon drive systems, as well as for inflatable air bag and rescue systems. Particularly in the civil sector thermomechanical insensitivity and non-toxicity of the starting mixtures, as well as a lack of toxicity in the resulting gases is sought. Many systems in use do not or only very inadequately fulfil these requirements.

The reaction of these fuels with the hitherto used catalysts and oxidizers leads to an unsatisfactory gas composition and/or to an inadequate burn-up behaviour. In addition, many reaction mixtures have such a high combustion temperature that, for air bag applications, the thermally sensitive bag materials are damaged.

In the case of a mixture having the aforementioned structure, the problem of the invention is to lower the combustion temperature and raise the burn-up rate.

SUMMARY OF THE INVENTION

These fundamentally opposing requirements are fulfilled according to the invention in that the oxidizer comprises $Cu(NO_3)_2.3Cu(OH)_2$ and the catalyst is a metal oxide. As a result of the oxidizer provided according to the invention there is a cold and rapid combustion. The maximum pressure is reached within milliseconds, the gas temperature remaining below harmful limits. The hitherto necessary slag-forming agents, required in the known systems for binding pollutants, e.g. alkali oxides, can be avoided in the mixture according to the invention, so that a higher gas output can be obtained.

The catalyst used according to the invention mainly serves to reduce pollutant gases (CO and NO), the term "catalyst" being here understood in the wider sense of an active reaction component, which can itself be reacted and acts in a reaction-controlling and/or reaction-accelerating manner. In a phase of the reaction determined by the thermal stability of the metal oxides, the latter act as oxygen donors. The catalytic action in the pollutant gas conversion $CO+1/2\ O_2 \rightarrow CO_2$ can be influenced by the particle distribution and/or the average particle size of the oxides, which should be below 25 μm. Not only the metal oxide catalyst, but also the oxidizer are thermally and mechanically stable and in particular also not hygroscopic.

Particularly suitable as catalysts are oxides or mixed oxides of transition metals, but preference is given to the use of $V_2O_5/MoO_3$ mixed oxides, which contain proportions of the thermally unstable phase $V_2O_4$, which can be represented by the partial reduction of $V_2O_5$. Further oxides, e.g. $TiO_2$ can be used as promoters.

In particular for civil applications non-toxic starting compounds and non-toxic reaction products are required. These requirements are fulfilled by fuels with a high N content and a low C content. These include the known fuels TAGN (triaminoguanidine nitrate), NG (nitroguanidine), NTO (3-nitro- 1,2,3-triazol-5-one) and GZT (diguanidinium-5,5'-azotetrazolate), which is in particular characterized by a very high nitrogen content (DE 4 108 225). Preference is given to the use of TAGN, NG, NTO and in particular GZT within the framework of the mixture according to the invention for use in rescue and air bag systems.

A preferred mixture consists of GZT and $Cu(NO_3)_2*3Cu(OH)_2$ with compensated oxygen balance and up to 30 wt. % catalyst.

The coolant can wholly or partly comprise $Fe_2O_3$, whose oxidative characteristics in the reaction mixture can be additionally utilized (DE 41 33 655, EP 0 536 525).

BRIEF DESCRIPTION OF THE DRAWING

The FIGURE shows the behavior of pressure after ignition in the experiment described in the example.

EXAMPLE

A mixture is prepared consisting of GZT, a mixed oxide of $V_2O_5$ and $MoO_3$ with the empirical formula $V_6Mo_{15}O_{60}$ as the catalyst and $Cu(NO_3)_2*3Cu(OH)_2$ as the oxidizer in the ratio 24.6:15.07: 60.29 wt. %. This formulation is experimentally tested in a ballistic bomb in connection with its ignition and combustion behaviour and a pressure behaviour diagram according to the enclosure is obtained. The diagram shows that the mixture has good ignition and combustion characteristics. For a loading density of 0.1 $g/cm^3$ the maximum pressure is in the range 310 bar (31 MPa), which is reached after approximately 28 ms (t(pmax)=28 ms). The pressure increase time between 30 and 80% of the maximum pressure is $t_{30-80}$=5.52 ms.

The combustion temperature can be very accurately determined by thermodynamic calculation and is 2122 K. With the same fuel GZT and compensated oxygen balance other oxidizers give higher combustion temperatures, e.g. 2501 K for $KNO_3$, 2850K for $NH_4NO_3$ and 3248K for $KClO_3$.

I claim:

1. A gas generating mixture comprising a fuel, an oxidizer, a catalyst and a coolant, wherein the oxidizer is $Cu(NO_3)_2*3Cu(OH)_2$ and the catalyst a metal oxide.

2. A mixture according to claim 1, wherein the catalyst is a metal oxide mixture.

3. A mixture according to claim 2, wherein the catalyst is a mixture of transition metal oxides.

4. A mixture according to claim 1, wherein the catalyst is a mixed metal oxide.

5. A mixture according to claim 4, wherein the catalyst is a mixed transition metal oxide.

6. A mixture according to claim 1, wherein the catalyst is a mixture of transition metal oxides.

7. A mixture according to claim 1, wherein the catalyst is a mixed transition metal oxide.

8. A mixture according to claim 7, wherein the catalyst comprises $V_2O_5/MoO_3$ mixed oxides.

9. A mixture according to claim 8, wherein the catalyst also comprises $TiO_2$.

10. A mixture according to claim 8, wherein the catalyst has an average particle size of <25 μm.

11. A mixture according to claim 8, comprising a mixture of GZT and $Cu(NO_3)_2*3Cu(OH)_2$ with a compensated oxygen balance and a catalyst content in the reaction mixture of up to 30 wt. %.

12. A mixture according to claim 8, wherein the catalyst comprises the thermodynamically unstable $V_2O_4$ phase.

13. A mixture according to claim 1, wherein the catalyst comprises $TiO_2$.

14. A mixture according to claim 1, wherein the catalyst has an average particle size of <25 μm.

15. A mixture according to claim 1, wherein the fuel comprises TAGN (triaminoguanidine nitrate), NG (nitroguanidine), NTO (3-nitro-1,2,3-triazol-5-one) or GZT (diguanidinium-5,5'-azotetrazolate).

16. A mixture according to claim 1 comprising a mixture of GZT and $Cu(NO_3)_2*3Cu(OH)_2$ with a compensated oxygen balance and a catalyst content in the reaction mixture of up to 30 wt. %.

17. A mixture according to claim 1, wherein the coolant comprises $Fe_2O_3$.

18. A mixture according to claim 5, wherein the catalyst comprises $V_2O_5/MoO_3$ mixed oxides.

19. A mixture according to claim 18, wherein the catalyst comprises the thermodynamically unstable $V_2O_4$ phase.

20. A mixture according to claim 16, wherein the coolant comprises $Fe_2O_3$.

* * * * *